US008402716B2

(12) United States Patent
Tinianov et al.

(10) Patent No.: US 8,402,716 B2
(45) Date of Patent: Mar. 26, 2013

(54) ENCAPSULATED COMPOSIT FIBROUS AEROGEL SPACER ASSEMBLY

(75) Inventors: Brandon D. Tinianov, Santa Clara, CA (US); Kent Whiting, Sunnyvale, CA (US); Court Hinricher, Sunnyvale, CA (US)

(73) Assignee: Serious Energy, Inc., Sunnyvale, CA (US)

( * ) Notice: Subject to any disclaimer, the term of this patent is extended or adjusted under 35 U.S.C. 154(b) by 236 days.

(21) Appl. No.: 12/328,746

(22) Filed: Dec. 4, 2008

(65) Prior Publication Data

US 2010/0139195 A1 Jun. 10, 2010

Related U.S. Application Data

(63) Continuation-in-part of application No. 12/124,609, filed on May 21, 2008, now Pat. No. 7,954,283.

(51) Int. Cl.
*E06B 3/964* (2006.01)

(52) U.S. Cl. ..... 52/786.13; 52/204.62; 49/501; 49/DIG. 1

(58) Field of Classification Search ..... 52/786.13, 52/204.593, 204.6, 204.62; 428/34; 49/501, 49/DIG. 1
See application file for complete search history.

(56) References Cited

U.S. PATENT DOCUMENTS

| | | | | | |
|---|---|---|---|---|---|
| 3,553,913 | A | | 1/1971 | Eisenberg | |
| 3,733,237 | A | * | 5/1973 | Wolff | 156/468 |
| 3,775,914 | A | * | 12/1973 | Patil | 52/172 |
| 3,919,023 | A | | 11/1975 | Bowser et al. | |
| 4,113,905 | A | | 9/1978 | Kessler | |
| 4,186,522 | A | | 2/1980 | Hooks | |
| 4,198,254 | A | | 4/1980 | Laroche et al. | |
| 4,205,104 | A | * | 5/1980 | Chenel | 428/34 |
| 4,222,213 | A | | 9/1980 | Kessler | |
| 4,226,063 | A | | 10/1980 | Chenel | |
| 4,431,691 | A | | 2/1984 | Greenlee | |
| 4,462,390 | A | | 7/1984 | Holdridge et al. | |
| 4,564,540 | A | | 1/1986 | Davies et al. | |
| 4,687,687 | A | * | 8/1987 | Terneu et al. | 428/34 |
| 4,831,799 | A | | 5/1989 | Glover et al. | |
| 4,952,430 | A | * | 8/1990 | Bowser et al. | 428/34 |
| 5,007,217 | A | | 4/1991 | Glover et al. | |
| H0000975 | H | * | 11/1991 | Selkowitz et al. | 52/172 |
| 5,286,537 | A | | 2/1994 | Oita et al. | |
| 5,290,611 | A | | 3/1994 | Taylor | |
| 5,306,555 | A | * | 4/1994 | Ramamurthi et al. | 442/63 |
| 5,485,709 | A | | 1/1996 | Guillemet | |

(Continued)

OTHER PUBLICATIONS

PCT International Search Report and the Written Opinion mailed Jan. 28, 2010, in related International Application No. PCT/US2009/066575.

(Continued)

*Primary Examiner* — Robert Canfield
*Assistant Examiner* — Brent W Herring
(74) *Attorney, Agent, or Firm* — Haynes and Boone, LLP

(57) ABSTRACT

An insulating spacer for creating a thermally insulating bridge between spaced apart panes of a multiple pane window unit comprises in one embodiment, a solid fiber-stabilized aerogel insulation material, hardened with a desiccant-impregnated hot melt adhesive. The spacer defines a thermally insulated space between the panes. Several embodiments of the insulating spacer of the present invention are disclosed. Insulated glass units using the disclosed insulating spacers and windows employing these insulated glass units have significantly better thermal performance than prior art insulated glass units and windows.

28 Claims, 7 Drawing Sheets

U.S. PATENT DOCUMENTS

| | | | | |
|---|---|---|---|---|
| 5,487,937 | A * | 1/1996 | Newby | 428/317.1 |
| 5,512,341 | A * | 4/1996 | Newby et al. | 428/35.8 |
| 5,514,428 | A * | 5/1996 | Kunert | 428/34 |
| 5,557,462 | A * | 9/1996 | Hartig et al. | 359/585 |
| 5,683,764 | A * | 11/1997 | Alts | 428/34 |
| 5,851,609 | A * | 12/1998 | Baratuci et al. | 428/34 |
| 5,962,090 | A * | 10/1999 | Trautz | 428/34 |
| 5,973,015 | A | 10/1999 | Coronado et al. | |
| 5,983,593 | A * | 11/1999 | Carbary et al. | 52/786.11 |
| 6,035,602 | A | 3/2000 | Lafond | |
| 6,068,882 | A | 5/2000 | Ryu | |
| 6,136,446 | A | 10/2000 | Virnelson et al. | |
| 6,235,356 | B1 * | 5/2001 | Shibuya et al. | 428/34 |
| 6,355,328 | B1 * | 3/2002 | Baratuci et al. | 428/68 |
| 6,581,341 | B1 | 6/2003 | Baratuci et al. | |
| 6,605,358 | B1 * | 8/2003 | Stachowiak | 428/432 |
| 6,887,563 | B2 | 5/2005 | Frank et al. | |
| 6,926,967 | B2 * | 8/2005 | Neuman et al. | 428/432 |
| 6,989,188 | B2 | 1/2006 | Brunnhofer et al. | |
| 7,078,359 | B2 | 7/2006 | Stepanian et al. | |
| 7,183,524 | B2 * | 2/2007 | Naylor et al. | 219/528 |
| 7,270,851 | B2 | 9/2007 | Sullivan | |
| 7,270,859 | B2 | 9/2007 | Acevedo et al. | |
| 7,954,283 | B1 | 6/2011 | Tinianov | |
| 2003/0215648 | A1 * | 11/2003 | Varanasi et al. | 428/432 |
| 2006/0263587 | A1 | 11/2006 | Ou et al. | |
| 2007/0116907 | A1 | 5/2007 | Landon et al. | |
| 2007/0122588 | A1 * | 5/2007 | Milburn | 428/117 |
| 2009/0029147 | A1 * | 1/2009 | Tang et al. | 428/319.1 |
| 2009/0069455 | A1 * | 3/2009 | Sekiya et al. | 521/81 |
| 2010/0139193 | A1 * | 6/2010 | Goldberg et al. | 52/309.3 |

OTHER PUBLICATIONS

ASTM International, www.astm.org, retrieved on Mar. 31, 2010.

Aspen Aerogels Cryogel product data sheet, 2007, http://www.aerogel.com/products/pdf/Cryogel_Z_DS.pdf, retrieved on Mar. 31, 2010.

Aspen Aerogels Spaceloft Insul-Cap brochure, 2007, http://www.aerogel.com/Aspen_Aerogels_Insulcap.pdf, retrieved on Mar. 31, 2010.

J. Carmody, et al., Window Systems for High-Performance Buildings, W. W. Norton & Co., p. 93, 2004.

US DOE Envelope and Windows R&D Roadmap, presented at the US DOE Envelope and Windows R&D Roadmap Workshop Buildings Conference, Dec. 6, 2007, http://www.govforums.org/E&W/documents/1_US_DOE_Envelope_and_Window_R&D_Roadmap.pdf, retrieved on Mar. 31, 2010.

Aspen Aerogel Translucent Panels Presentation, presented at the US DOE Envelope and Roadmap Workshop Buildings Conference, Dec. 6, 2007, http://www.govforums.org/E&W/documents/11_Aspen_Aerogel_Translucent_Panels.pdf, retrieved on Mar. 31, 2010.

S.J. Teichner, et al., "Inorganic Oxide Aerogel", Advances in Colloid and Interface Science, vol. 5, pp. 245-273, 1976.

L.D. Lemay, et al., "Low-Density Microcellular Materials", MRS Bulletin, vol. 15, p. 19, 1990.

Linear Expansion Coefficients Table—http://web.archive.org/web/20060222145423/http://www.engineeringtoolbox.com/linear-expansion-coefficients-d_95.html—Feb. 22, 2006.

John Carmody et al., Window Systems for High-Performance Buildings, publication date Dec. 15, 2003, p. 93.

* cited by examiner

ENCAPSULATED COMPOSIT FIBROUS AEROGEL SPACER ASSEMBLY

CROSS-REFERENCE TO RELATED APPLICATIONS

This application is a continuation-in-part of, claims priority to and the benefit of, co-pending U.S. patent application Ser. No. 12/124,609, filed in the U.S. Patent and Trademarks Office on May 21, 2008, the entire contents of which are incorporated herein by reference.

FIELD OF THE INVENTION

This invention generally relates to an insulating spacer and in particular to an insulating spacer for creating a thermally insulating bridge between spaced-apart panes in a multiple glass panel window unit, for example, to improve the thermal insulation performance of the unit. This invention also relates to methods of making such an insulating spacer.

BACKGROUND OF THE INVENTION

An important consideration in the construction of buildings is energy conservation. In view of the extensive use of glass in modern construction, a particular problem is heat loss through glass surfaces and glazed building envelopes. One solution to this problem has been an increased use of insulating glass units comprising basically two or more glass panels separated by a sealed dry air space. Sealed insulating glass units generally require some means of mechanically separating the glass panels by a precise distance, such as by rigid spacers.

The spacers historically used are rectangular channels made of steel, aluminum or some other metal, with an internal desiccant to adsorb moisture from the space between the glass panels and to keep the encapsulated sealed air space dry. Tubular spacers are commonly roll-formed into the desired cross sectional shape. Steel spacers are generally considered the cheapest and strongest option, but aluminum spacers are easier to cut and form into non standard window shapes such as semicircles. Aluminum also provides lightweight structural integrity, but it is more expensive than steel. Metal spacers are manufactured by PPG of Pittsburgh, Pa. Spacers made entirely of plastic or from a combination of metal and plastic, termed warm edge spacers, have also been used to a limited extent. Manufacturers of these types of spacers include EdgeTech I.G., Inc. of Cambridge, Ohio and Swisspacer of Kreuzlingen, Switzerland.

There are specific factors that influence the suitability of the spacer material or design for use in high performance windows. Of most importance are the spacer's heat conducting properties and the spacer material's coefficient of thermal expansion. To date, metal has been the most widely used spacer material even though as a material it has a number of disadvantages in both of these areas. First, the thermal conductivity of metal is unacceptably high for use as a spacer. Since a metal spacer is a much better conductor of heat than is the glass or the air space between the panes of glass, its use leads to the rapid transfer of heat between the inside glass pane and the outside glass pane resulting in heat dissipation, energy loss, moisture condensation and other window assembly performance shortcomings. For example, in a sealed insulated glass unit, heat from within a building tries to escape in winter, and it takes the path of least resistance. The path of least resistance is around the perimeter of a sealed window unit, where the metal spacer bar is located. Metal spacers contacting the inner and outer panes of glass act as conductors between the panes and provide an easy path for the transmission of heat from the inside glass panel to the outside panel. As a result, under low temperature conditions in winter, condensation of moisture can occur inside the insulating glass or on the surfaces of the inner glass panel. Also, heat is rapidly lost from around the perimeter of the window, often causing a ten to twenty degree Fahrenheit temperature drop at the perimeter of the window relative to the center thereof. Under extreme conditions in winter, a frost line can occur around the perimeter of the window unit. These conditions undermine the energy efficiency of the window, and ultimately, the energy efficiency of the building itself.

A second important feature of the spacer material is its coefficient of thermal expansion. The coefficient of expansion of commonly used spacer materials is much higher than that of glass. Any difference in thermal expansion causes problems in the form of glass stress, seal shear and failure, or spacer damage. For example, the coefficient of linear thermal expansion for steel is twice that of glass ($17.3\times10^{-6}$ inches per degrees K. versus $8.5\times10^{-6}$ inches per degrees K.). This difference is particularly critical in climates that have large changes in temperature. As a result of such changes in temperature, stresses do develop at the interface between the glass and spacer bar and in the perimeter seal. This often results in damage to and failure of the sealed insulating glass unit, such as by sufficient lengthwise shrinkage of the spacer to cause it to pull away from the sealant and therefore cause premature failure of the insulating glass unit. Many window units tend to fail due to such stress cracks or loss of seal resulting in water vapor condensation which is deposited inside the panes and observed as window fogging. Such a condition results in a warranty callback and a window replacement.

Although the issue of thermal expansion is important to window durability, the most common spacer material commercially used in the manufacture of such insulated glass units has been metal due to cost and a lack of viable alternate materials.

U.S. Pat. Nos. 4,222,213 and 5,485,709 disclose additional composite spacers. Both patents disclose a thin plastic insulation which is in contact with one glass surface and thereafter fitted by contact pressure or friction over a portion of a conventional extruded or roll-formed metal spacer or plastic/metal composite. The plastic insulating overlay can be formed over a conventional extruded metal spacer and from an extrudable thermoplastic resin. However, the force fit and the bi-material construction of such a spacer can result in separation of the two components with changes in temperature due to the different thermal expansion coefficients of the metal and the plastic and again allow for substantial thermal bridging across the structure. These features are undesirable.

Descriptions of additional composite window unit spacer designs can also be found in U.S. Pat. Nos. 6,035,602, 6,581,341, 6,989,188, 6,136,446 and 7,270,859.

Accordingly, what is needed is an insulating spacer which creates a thermally insulating bridge between spaced-apart panes in a multiple pane, insulated glass unit which overcomes the above-noted drawbacks.

SUMMARY OF THE INVENTION

It is an object of the present invention to provide an improved thermally insulating spacer for a multiple pane, insulated glass unit which solves or overcomes the drawbacks noted above with respect to conventional spacers.

It is another object of this invention to create a thermally insulating bridge to reduce heat transfer from one pane of the window (glass or polyester film) to another through the insulating spacer of the present invention. This invention thus keeps the inner pane of material (glass or polyester film) several degrees warmer than it might otherwise be in the winter, while preventing condensation that otherwise may occur. This invention also improves the thermal efficiency of the window unit.

It is another object of the present invention to provide an insulating spacer with a coefficient of expansion approximately equal to that of glass.

It is another object of the present invention to provide an improved composite insulating spacer which has the features necessary for a spacer relating to water vapor transmission, gas permeability, ultraviolet light resistance, dust containment, desiccant containment and ease of handling as well as the ability to be manufactured to precise dimensional tolerances.

It is still another object of the present invention to improve the speed and yield of high performance window fabrication by providing a spacer that is easily handled, cut to precise lengths, and placed onto its host materials.

The present invention provides an insulating spacer for spacing apart panes of a multiple pane window unit, for example, and for defining an insulated space between the panes. The insulating spacer comprises an assembly of selected materials that encapsulate an aerogel composite core, specifically a fiber reinforced aerogel (FRA). The spacer may consist entirely of an FRA and a resin or hot melt adhesive hardener, an FRA core, a structural stiffener and a UV resistant wrap, such as shrink tubing, woven or polymer wrap, or some combination of these materials.

Fiber reinforced aerogels (FRA) have the lowest thermal conductivity value of any material currently used in building construction. They have thermal conductivities of 12 to 18 mW/m-K, where "mW" is milliwatts, "m" represents meter, and K is degrees Kelvin. By comparison, metals such as copper, aluminum, and stainless steel have much higher thermal conductivities of 36,000 mW/m-K, 20,400 mW/m-K, and 12,000 mW/m-K, respectively. Even closed cell foams designed for thermal insulation such as expanded polystyrene and polyisocyanurate have thermal conductivities of 32 and 24 mW/m-K, respectively. In addition to their low thermal conductivity, FRAs exhibit good moisture and water vapor resistance. The FRA is hydrophobic with excellent resistance to moisture. The material's series of nanopores embedded into a fibrous matrix form a tortuous gas-resistive network that resists vapor penetration, condensation and ice crystallization. FRAs also exhibit good dimensional stability and structural integrity over a broad range of temperatures. Typically available FRAs have a range of service temperatures over 200 degrees C., which is greater than that required for the building envelope. Across the service temperature, the FRA remains flexible and is not subject to contraction, thermal shock or degradation from thermal cycling as are foams. Last, FRAs have a coefficient of thermal expansion similar to that of glass. The result is that once these materials are bonded together there are no additional stresses due to temperature change. Therefore, the present invention improves the thermal performance of the insulated glass units along the edge of the assembly where unwanted heat transfer is a particular problem.

The construction of such fiber reinforced aerogel materials suitable for construction applications is disclosed in U.S. Pat. No. 6,068,882, by Jaesoek Ryu. This patent is hereby incorporated by reference herein in its entirety, and will be referred to as "Ryu". Described in general process steps, the fiber reinforced aerogel (FRA) is prepared by impregnating a fibrous matrix with an aerogel precursor solution so that a liquid phase is placed around every fiber and then, without aging of the precursor solution to form a gel, supercritically drying the impregnated matrix under conditions such that substantially no fiber—fiber contacts are present. The fibrous matrix consists of a nonwoven felt or blanket. The fibers are generally oriented in a parallel fashion. Fibers often consist of PET or a PET and fiberglass blend with a diameter of 100 microns or less, preferably with diameters between 5 and 20 microns (see Ryu, 5: 15-65, and Table I for further examples). Commercially available examples of suitable fiber matrix materials include Q-fiber by Johns Manville, Inc. Of Denver, Colo., Nicalon by Dow Corning of Midland, Mich., and Duraback by Carborundum of Niagara Falls, N.Y. Supercritical drying is achieved by heating the autoclave to temperatures above the critical point of the solvent under pressure, e.g. 260° C. and more than 1,000 psi for ethanol, generally in the range of 1 to 4 hours (see Ryu, 10: 16-17). The resulting composite insulation contains aerogels distributed substantially uniformly throughout the fibrous matrix. This general process is discussed in detail below.

To fully obtain the benefit of the composite configuration, each fiber within the fibrous matrix is completely surrounded by aerogels such that all fiber to fiber direct contact is avoided. The substantial absence of fiber to fiber contacts is accomplished by a combination of (1) selection of compatible fibrous matrices and aerogels, (2) impregnation of the fibrous matrix with an aerogel sol so that the liquid phase surrounds every fiber, and (3) controlled aerogel processing procedures. Products utilizing this technology are commercially available from Aspen Aerogels of Northborough, Mass. in the manufacture of their Spaceloft, Cryogel, and Pyrogel products.

In the process of the FRA manufacture, the principal synthetic route for the formation of aerogels is the hydrolysis and condensation of an alkoxide. Major variables in the aerogel formation process are the type of alkoxide, solution pH, and alkoxide/alcohol/water ratio. Control of these variables permits control of the growth and aggregation of the aerogel species throughout the transition from the "sol" state to the "gel" state during drying at supercritical conditions. For low temperature applications, the preferred aerogels are prepared from silica, magnesia, and mixtures thereof (Ryu, 6: 1-17).

After formation of the alkoxide-alcohol solution, water is added to cause hydrolysis so a metal hydroxide in a "sol" state is present. Techniques for preparing such aerogel "sol" solutions are well known in the art. (See, for example, S. J. Teichner et al., "Inorganic Oxide Aerogel," Advances in Colloid and Interface Science, Vol. 5, 1976, pp 245-273, and L. D. LeMay, et al., "Low-Density Microcellular Materials," MRS Bulletin, Vol. 15, 1990, p 19).

Next, the fibrous matrix may be placed in an autoclave, the aerogel-forming components (metal alkoxide, water and solvent) added thereto, and the supercritical drying then immediately commenced. Supercritical drying is achieved by heating the autoclave to temperatures above the critical point of the solvent under pressure, e.g. 260° C. and more than 1,000 psi for ethanol.

Following a dwell period (commonly about 1-2 hours), the autoclave is depressurized to the atmosphere in a controlled manner, generally at a rate of about 5 to 50, preferably about 10 to 25, psi/min. Due to this controlled depressurization there is no meniscus in the supercritical liquid and no damaging capillary forces are present during the drying or retreating of the liquid phase. As a result, the solvent (liquid phase) (alcohol) is extracted (dried) from the pores without collapsing the fine pore structure of the aerogels, thereby leading to the enhanced thermal performance characteristics.

A commercially available fiber reinforced aerogel product is Spaceloft, manufactured by Aspen Aerogels of Northborough, Mass. To date, fiber reinforced aerogels have been used as interlayers over stud framing in walls, thermal clothing, and cladding for pipes and ducts. In U.S. patent application Ser. No. 12/124,609 filed May 21, 2008 and assigned to the same assignee as the assignee of this invention, Tinianov discloses a fibrous aerogel assembly for use as a spacer in window insulated glass units, but does not address the dust mitigation, water vapor management, low heat transfer, and manufacturing issues as treated in the present invention. Patent application Ser. No. 12/124,609 is hereby incorporated by reference in its entirety.

As will be appreciated by those skilled in the art, in addition to the multiple glass or polyester film (or more specifically biaxially-oriented polyethylene terephthalate (PET), commonly referred to as Mylar or Melinex) panes and the aerogel spacer, the complete insulating glass unit assembly may employ polyisobutylene (PIB), butyl, hot melt, or any other suitable sealant or butylated material as a sealant and adhesive to bond the perimeter of the insulated glass unit. Sealing or other adhesion for the insulating spacer is necessary both to ensure the structural integrity of the window unit, but also to act as a gas and water vapor barrier isolating the ambient atmosphere from the atmosphere within the insulated glass unit for the service life of the window. These sealing needs may be achieved by providing special adhesives, e.g., acrylic adhesives, pressure sensitive adhesives, or hot melt adhesive. Multiple sealant layers may be used. By providing at least two different sealing materials as is described below, the result is that discrete and separate sealing surfaces are in place to protect the spacer. This is useful in the event that one seal is compromised. The sealant materials may be embedded within one another.

In addition to the flexible, thermally insulating spacer, the assembly may include an additional vapor barrier about the rear face of the insulated glass unit. Regarding the vapor barrier, it may be a plastic film or tape, a metallized film or tape, metal tape or other material well known to those skilled in the art.

A better understanding of these and other advantages of the present invention, as well as objects attained for its use, may be had by reference to the drawings and to the accompanying descriptive matter, in which there are illustrated and described preferred embodiments of the invention.

BRIEF DESCRIPTION OF THE DRAWINGS

Throughout the views, like or similar reference numerals have been used for like or corresponding parts.

DETAILED DESCRIPTION OF THE PREFERRED EMBODIMENTS

Figure 1:
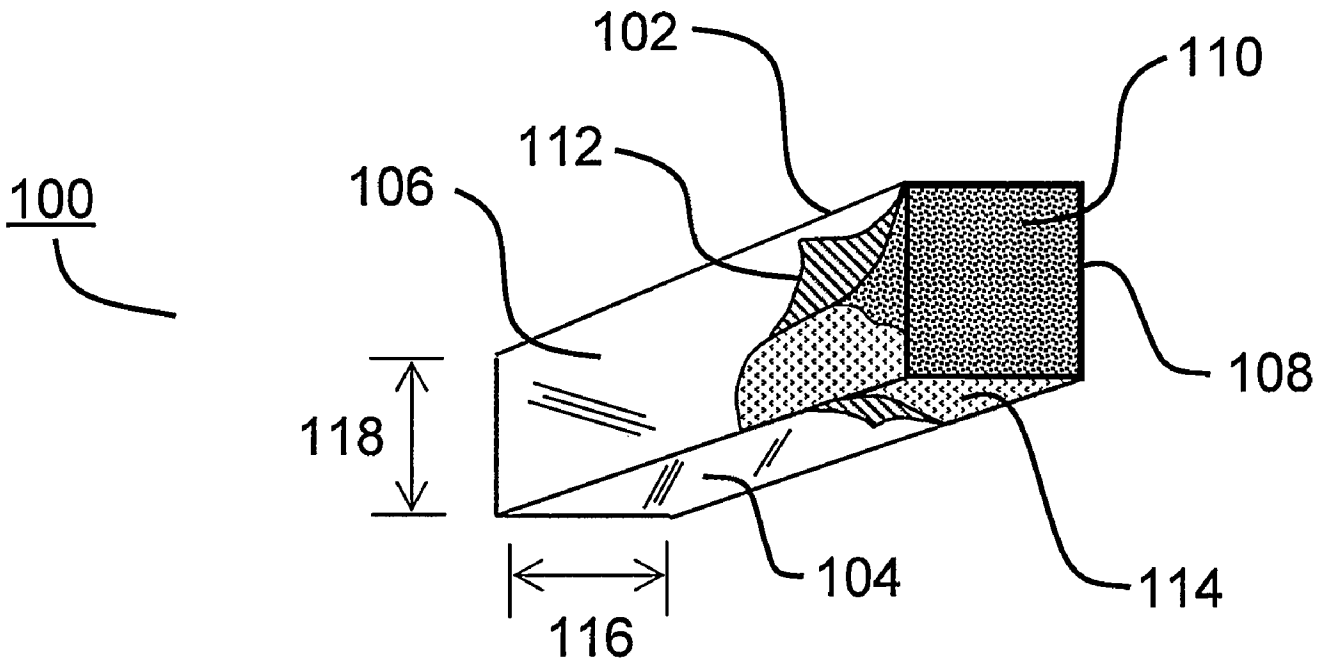
FIG. 1 is a perspective view of one embodiment of the present invention.
Figure 3:
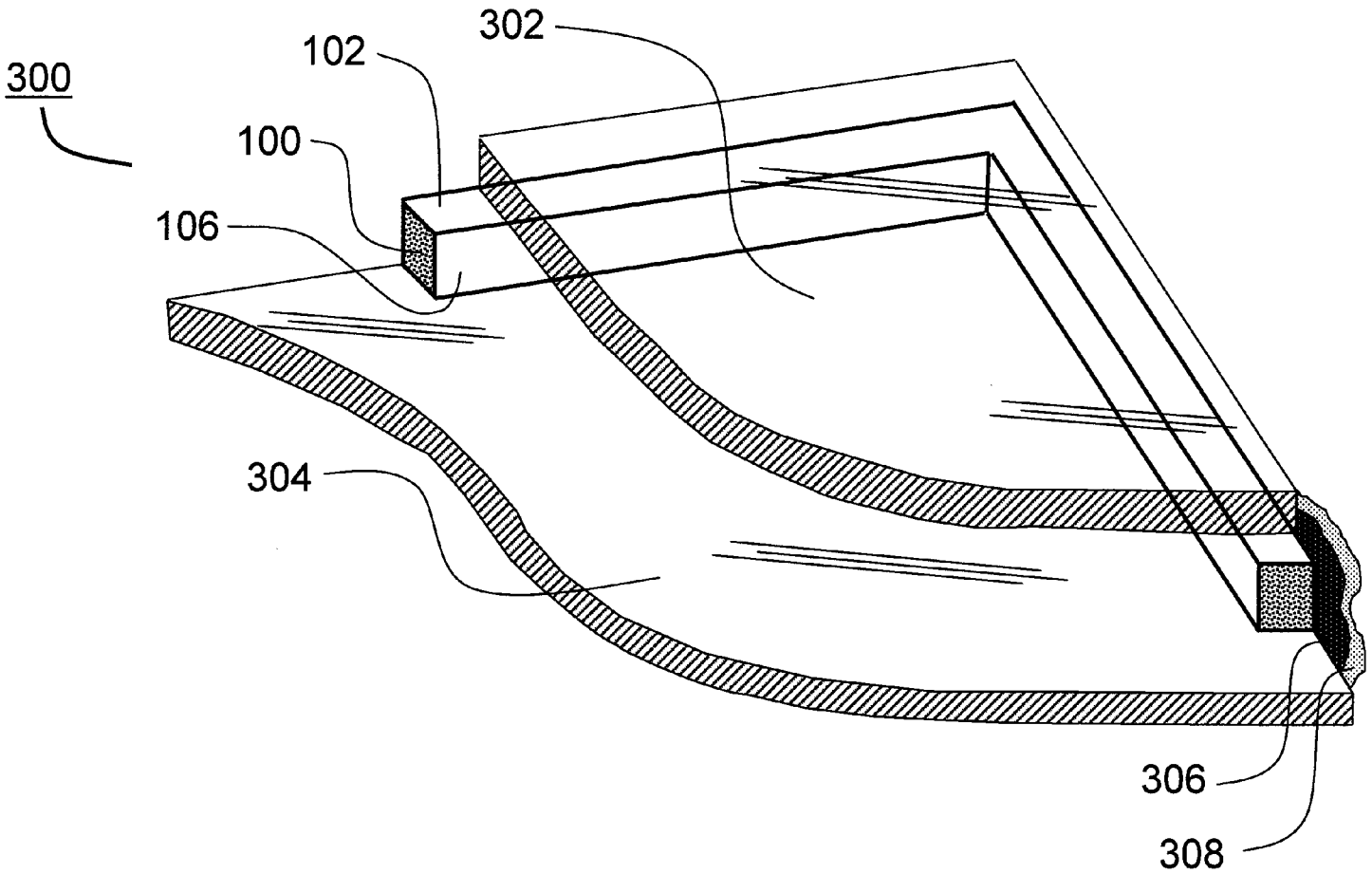
FIG. 3 is a perspective view of the present invention in-situ between substrates typical of a dual glaze insulated glass unit.

FIG. 1 shows one embodiment of a spacer 100 in accordance with this invention. In the embodiment shown, spacer 100 includes a pair of window pane contact surfaces 102 and 104 in spaced relation to each other so as to separate two glass or plastic panes by a given distance. The spacer body 100 includes a front face 106 inwardly directed to the space between the two panes of glass, and a rear or outwardly directed face 108. The front face 106 faces the interior of an insulated glass unit assembly, as shown in FIG. 3. As shown in the example embodiment, the four faces, 102, 104, 106 and 108 are each coated or clad with one or more layers of material, 112 and 114, making the spacer suitable for direct bonding between two glass or plastic sheets. These coatings and/or claddings may consist of a single material layer (whereby either layer 112 or 114 would not be present) or multiple material layers that achieve the desired physical attributes. Suitable material layer 112 may include a vinyl or other plastic, a nonwoven fabric or aromatic nylon, a butyl or other durable coating, or even a metal foil or other thin metallic skin. Alternately, the layer 114 may include a hardening resin, hot melt adhesive, or structural member such as a plastic, fiberglass or other rigid profile. A first required attribute of material 112 is that of acceptable water vapor transmission across the material. Material 112 must allow water vapor, present in the moist cavity air to transfer to a desiccant material in or behind the spacer. For this reason, layers 112 and/or 114 should have a water vapor permeability of 10 perms or more, as measured by ASTM test method E-96 (Standard Test Method for Water Vapor Transmission of Materials). One perm is defined as the transport of one grain of water per square foot of exposed area per hour with a vapor pressure differential of 1-inch of mercury. Further information may be found on the Internet at http://www.astm.org. If the desiccant material is not housed in the core material 110, then materials 112 and 114 do not have to allow ready water vapor transfer.

A second physical attribute of the layer system consisting of materials 112 and 114 is that of dust and desiccant containment. The fiber reinforced aerogel 110 is a composite impregnated with many small particles of about 1 to 400 mm. Whenever the core is flexed or otherwise disturbed, it will shed these particles in the form of a fine dust. Dust migrating to the viewable area of a window is unacceptable. In addition to dust from the aerogel core 110, materials 112 and 114 must also encapsulate the window desiccant. This can either be accomplished as an external wrap around a desiccant material or as a hot melt adhesive with desiccant incorporated into the glue itself. Desiccant comes in two forms for window use, either as small spherical pellets of approximately 1-5 mm diameter or as a powder. These desiccant materials are available from Delta Adsorbents of Roselle, Ill.

A third requirement is that the material layers 112 and 114 add rigidity to the core 110 to ease handling and to provide the ability to manufacture the composite insulating spacer to precise dimensional tolerances. Without sufficient rigidity, the panes may have imprecise spacing relative to each other which may impact the thermal performance and visual appeal of the insulated glass unit. In the embodiment illustrated in FIG. 1, material 114 may be rigid plastic, fiberglass composite, cardboard, Teflon or hot melt adhesive. In the embodiment shown in FIG. 1, layer 112 is shown as overlying and attached to layer 114. Layer 112 may then be a limp or non-structural material such as non-woven fabric or film. Layer 112 may be attached to core 110 or layer 114 either by adhesive or wrapped and welded to itself in a seam along the outer face 108 forming a sleeve A final requirement of the material layer 114 is that of ultraviolet (UV) light resistance. In this case, the attribute of UV resistance signifies that the material will not crack or disintegrate, thereby allowing particles to shed into the viewable window area, over the twenty year life of the window.

The layers 112 and 114 may be permanently applied such as by direct adhesion to the four surfaces 102, 104, 106 and 108 using a commercially available adhesive such as Super 77 Spray manufactured by 3M of St. Paul, Minn. Alternately, the core 110 may be wrapped by a non-woven fabric which is welded to itself in a seam along the outer face 108 forming a sleeve. The thicknesses of layers 112 and 114 may be varied between about 2 to 50 mm to best suit the thermal, structural, and product cost needs of the assembly.

Figures 2A, 2B, 2C, 2D, 2E, 2F, 2G, 2H:
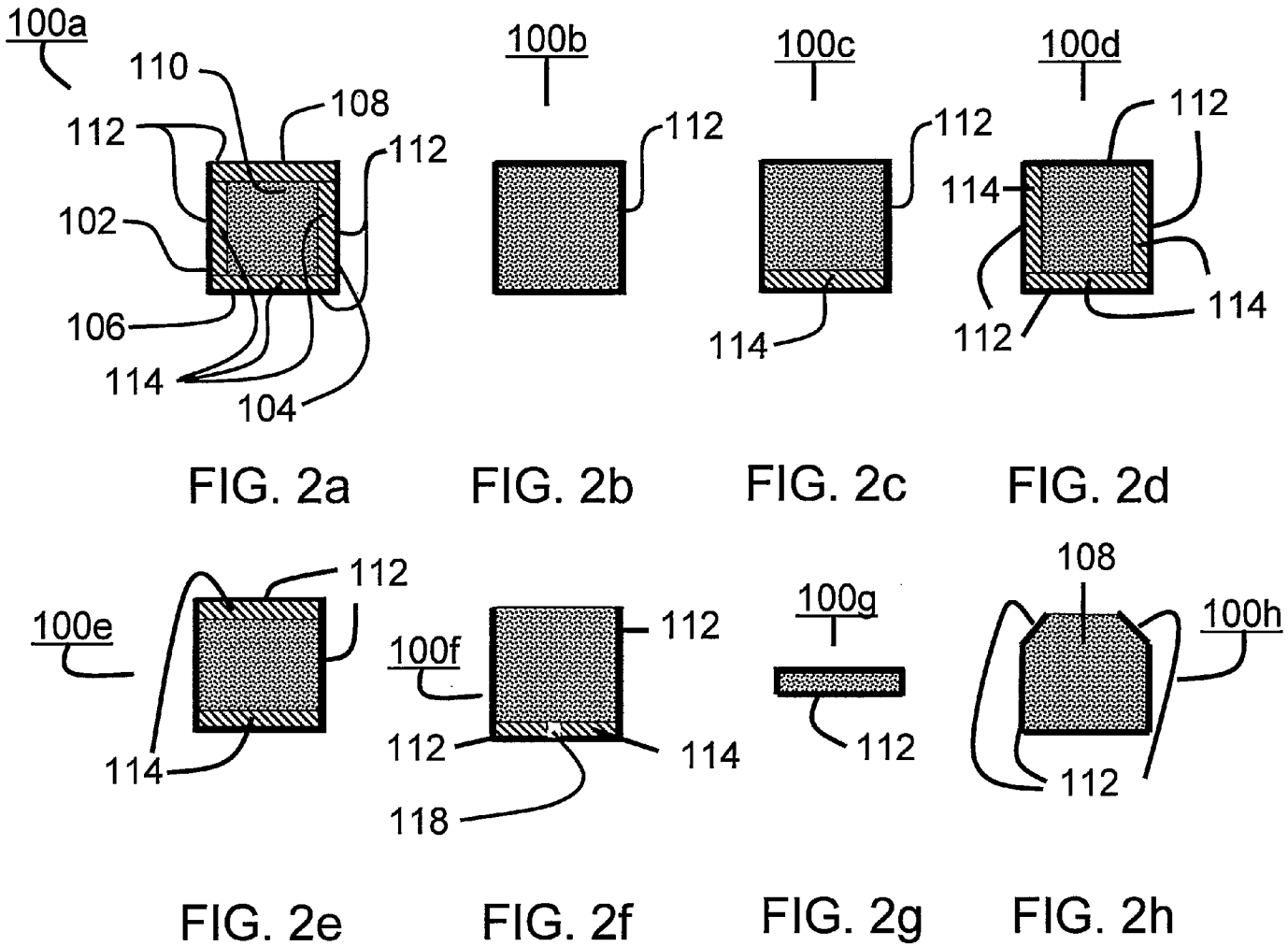
FIGS. 2*a* to 2*h* show in cross-section alternate embodiments of encapsulated insulating spacers of the type shown in FIG. 1.

In one embodiment, layers 114 as shown in FIG. 2*a* are formed of a hot melt adhesive impregnated with a desiccant material. Therefore, layers 114 add structural rigidity, act as a desiccant, and contain (i.e. prevent passage of) the dust from core 110. Layer 112 has only the material requirements of water vapor permeability and UV resistance.

FIGS. 2*a* through 2*h* show in cross-section further embodiments of the spacer 100 as illustrated in FIG. 1. As shown in FIGS. 2*a* through 2*h*, these spacer embodiments now incorporate varying configurations of external materials 112 and 114 in addition to the fiber reinforced aerogel 110. In one embodiment, layer 112 as shown in FIG. 2*b* is a UV resistant hot melt adhesive impregnated with a desiccant material. In this preferred embodiment, the single layer 112 creates an assembly with the combined attributes of structural rigidity, dust containment, dehumidification of the cavity, and durability to UV exposure. In FIG. 2*c*, the rigid support layer 114 may be a rigid hot melt adhesive impregnated with desiccant or another structural support. In this embodiment, layer 112 is then water vapor permeable and resistant to UV light. Layer 112 may be glued or wrapped and mechanically fastened around material 114 and core 110. In FIGS. 2*d* and 2*e*, the rigid support 114 has alternate configurations. In FIG. 2*f*, the rigid support layer 114 has periodic holes 118 to allow water vapor to pass across a solid layer such as plastic, resin, or even a rigid foam strip. In the embodiment of 2*g*, the spacer is similar to that of 2*b*, but the entire structure has a different cross section. FIG. 2*h* illustrates a proposed embodiment where the core is kerfed on the outer face 108 to allow greater contact between the spacer 100 and a sealant which will be placed around the outer perimeter of the window structure as shown by the sealant 306 in FIG. 3. In each of the examples shown in FIGS. 2*a* to 2*h*, the stiffening material 114 can be made of a metal, resin impregnation or hardening, or suitable plastic material.

One embodiment of the invention consists of a spacer as shown in FIG. 2*e*, wherein the two strips of a structural element for rigid support 114 are made of a metal such as steel and the layer of material 112 is made of a plastic such as polyvinyl chloride (PVC). The two strips 114 for rigid support extend along said spacer 100*e* so as to be beside and parallel to the two panes of glass which will be separated by spacer 100*e*, with the fiber reinforced aerogel material 110 between the two strips. Thus these steel strips 114 will not conduct heat from one glass pane to the other glass pane. This configuration limits conduction across the spacer and stiffens the spacer in the required direction; i.e. parallel to the two glass panes which will be separated by the spacer 100*e*. Other embodiments of the invention include one or more additional structural elements such as elements 114 in FIG. 2*e* placed within the spacer structure in any orientation with regard to the glass panes and the space in between them, in order to provide extra strength to the structure. However, the one or more elements 114 must be placed so as not to conduct significant heat from one glass pane to the other.

FIG. 3 is an embodiment depicting the spacer 100 as typically employed in an insulated glass assembly 300. Spacer 100 is positioned and bonded between two glass panels or sheets 302 and 304 about the perimeter. With greater detail concerning FIG. 1, the contact surfaces 102 and 104 and front face 106 each include a first cladding material which may comprise, as an example, a non-woven sheet. A first sealant 306 is shown at surface 108, and adjacent to this first sealant there is included a second sealant 308 or water vapor barrier differing from the first coat 306. Examples of probable vapor barrier materials suitable for use as the first sealant 306 and the second sealant 308 include polyisobutylene, polyurethane, polysulphide, 1-part silicone, and 2-part silicone. Additional film and foil sealants include polyester films, polyvinylfluoride films, metal films or foils, and any other appropriate material which prohibits the transfer of vapor and gas. In addition, the vapor barrier may be metallized. A useful example to this end is metallized polyethylene terephthalate film, a product available from DuPont of Wilmington, Del. Other suitable materials for the second sealant layer include acrylic adhesives, pressure sensitive adhesives, hot melt adhesive, polyisobutylene or other suitable butyl materials known to have utility for bonding such surfaces together.

Figure 4:
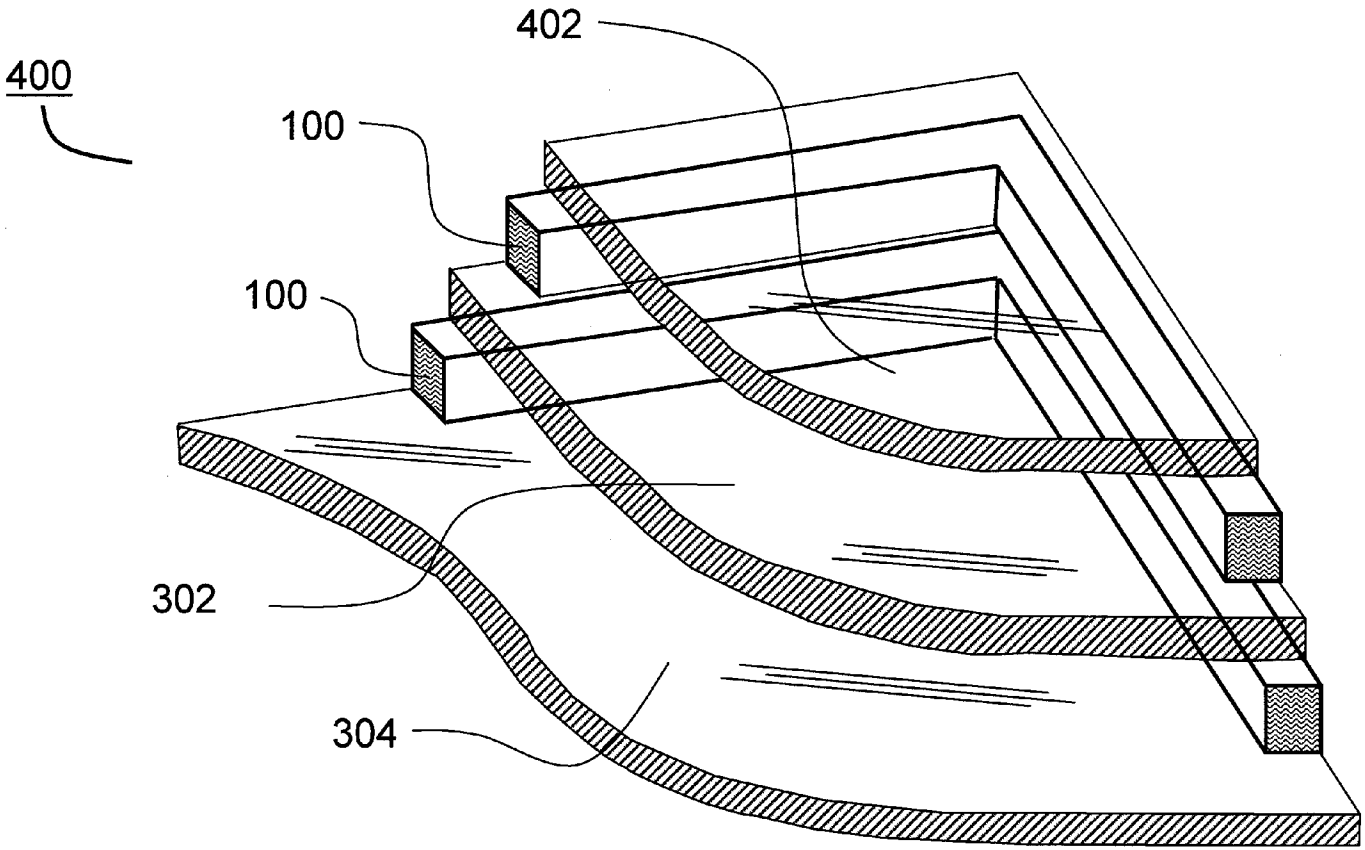
FIG. 4 is a perspective view of the present invention in-situ between substrates typical of a triple glaze insulated glass unit.

FIG. 4 shows a triple glazed insulated glass assembly 400 in which spacer 100 is employed. In assembly 400, two spacers 100 are positioned and bonded as shown between the perimeters of three glass panels or sheets 302, 304 and 402. The surface treatments of spacers 100 and the addition of adhesives, sealants and vapor barriers are the same as with assembly 300 shown in FIG. 3.

Figure 5:
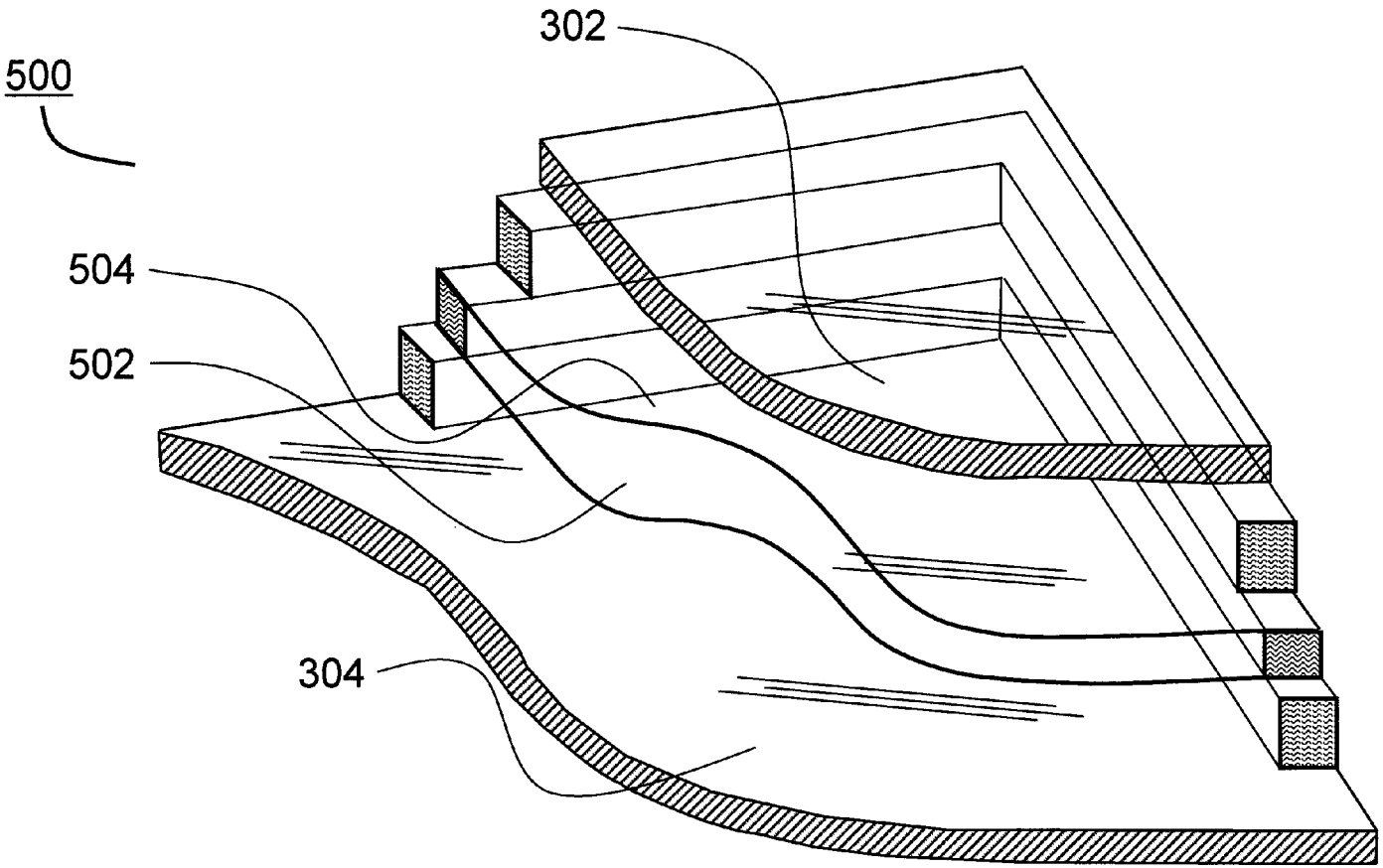
FIG. 5 is a perspective view of the present invention in-situ between substrates typical of a heat mirror glass unit (heat mirror embodiment).

FIG. 5 shows three spacers 100 employed in an insulated glass assembly 500. In this case, assembly 500 represents a high thermal performance design termed a heat mirror unit. Three spacers 100 are positioned and bonded three times between a total of four panes or sheets 302, 304 and 502 and 504 about their perimeters. Sheets 502 and 504 are each a special multi-layer metallized sheet of PET polyester film designed to reflect infrared energy. Sheets 502 and 504 are typically much thinner than traditional glass sheets and are considered non-structural. The surface treatment of each spacer 100 and the addition of adhesives, sealants and a vapor barrier are the same as with assembly 300 shown in FIG. 3.

Figure 6:
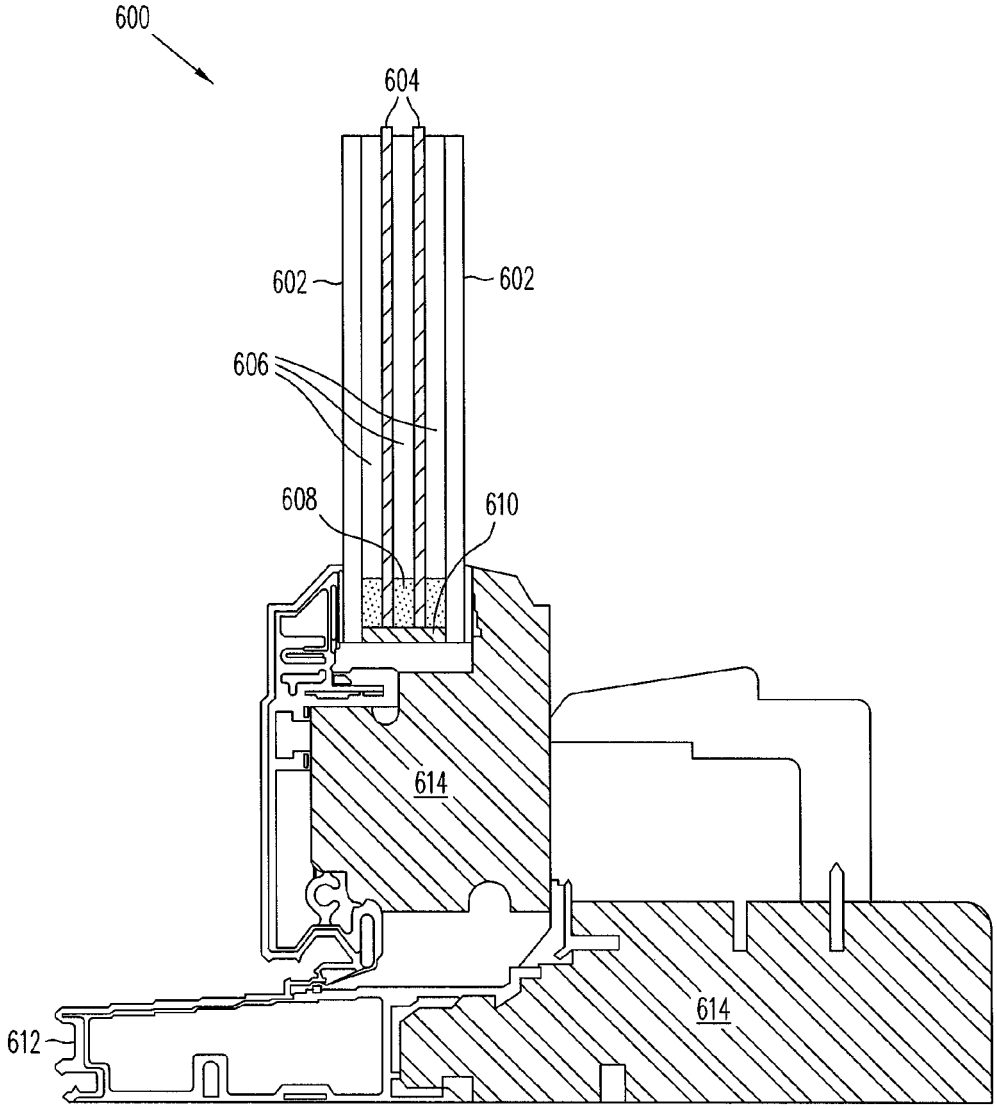
FIG. 6 is a cross section view of one embodiment of a window assembly that incorporates the insulated glass unit into a window frame.

FIG. 6 is a cross section view of the present invention incorporated into a typical window frame. Only the lower half of the window is represented. The upper section of the window and frame would be a mirror image of that shown here. The embodiment presented in FIG. 6 was modeled for thermal performance using industry standard window prediction software, THERM. THERM is a state-of-the-art, computer program developed at Lawrence Berkeley National Laboratory for use in modeling the heat transfer across building components such as windows, walls, and doors, where thermal bridges are of concern. THERM is also used by the product certification agency, the National Fenestration Rating Council (NFRC). NFRC is a non-profit organization that administers the only uniform, independent rating and labeling system for the energy performance of windows, doors, skylights, and attachment products. Its role is to provide fair, accurate, and reliable energy performance ratings so that architects, code officials, and homeowners can compare different products. In the embodiment modeled as a 1.22 m by 1.52 m window, the following elements were used. Components 602 were 4 mm thick glass coated with a low emissivity coating, LoE3-366 manufactured by Cardinal Glass of Eden Prairie, Minn. Components 604 were PET polyester film SC75 manufactured by Southwall Technologies of Palo Alto, Calif. The three voids 606 of the insulated glass unit 600 were filled with Krypton gas, a typical thermal insulator. The insulated glass unit was sealed by a 3 mm thick layer of polyurethane sealant 610, as manufactured by PRC-DeSoto International of Glendale, Calif. The window frame 612 used in this embodiment was a Series 400 fiberglass frame manufactured by Inline Fiberglass of Toronto, Ontario. Two cavities within the fiberglass frame 612 were filled with an expanding polyurethane foam 614 manufactured by BioBased Systems of Rogers, Ark. The present embodiment was modeled with two different window spacer materials 608. In a base case, spacers 608 were 9 mm deep steel tubes rolled and welded to a square cross section. In a second modeling case, the spacers 608 consisted of the 9 mm deep fiber reinforced aerogel 110, a 1 mm thick nylon stiffener 114, and a vinyl wrap 112 as shown in FIG. 2*c*. For the window model using steel spacers 608, the U-factor (which is a measure of the energy efficiency of the window in terms of thermal transmission) for the total window was 0.108. For the window model using fiber reinforced aerogel spacers 608, the U-factor for the total windows was 0.081. This represents a twenty five percent (25%) improvement in the thermal performance of the system, just by replacing the window spacer material and leaving all other window components unchanged.

As stated above, the U-factor is a measure of a system or assembly's thermal transmission or the rate of heat transfer through the system. Therefore, the lower the U-factor, the lower the amount of heat loss, and the better a product is, at insulating a building. In the present application, the U-factor is measured in units of Btu/(hrFt$^{2\circ}$ F.) (British thermal unit per hour, per square feet, per degree Fahrenheit), where 1 Btu/(hrFt$^{2\circ}$ F.)=5.666 W/(m$^2$ K) (Watts per meter squared, per degree Kelvin). Conversely, R-value is a measure of thermal resistance, and is the reciprocal of the above mentioned U-factor, i.e. R-value=1/U-factor. The units of the R-values reported in this application are therefore, hrFt$^{2\circ}$ F./Btu (with "R-values" defined according to the insulation resistance test set forth by the American Society for Testing and Materials in the Annual Book of ASTM).

Figure 7:
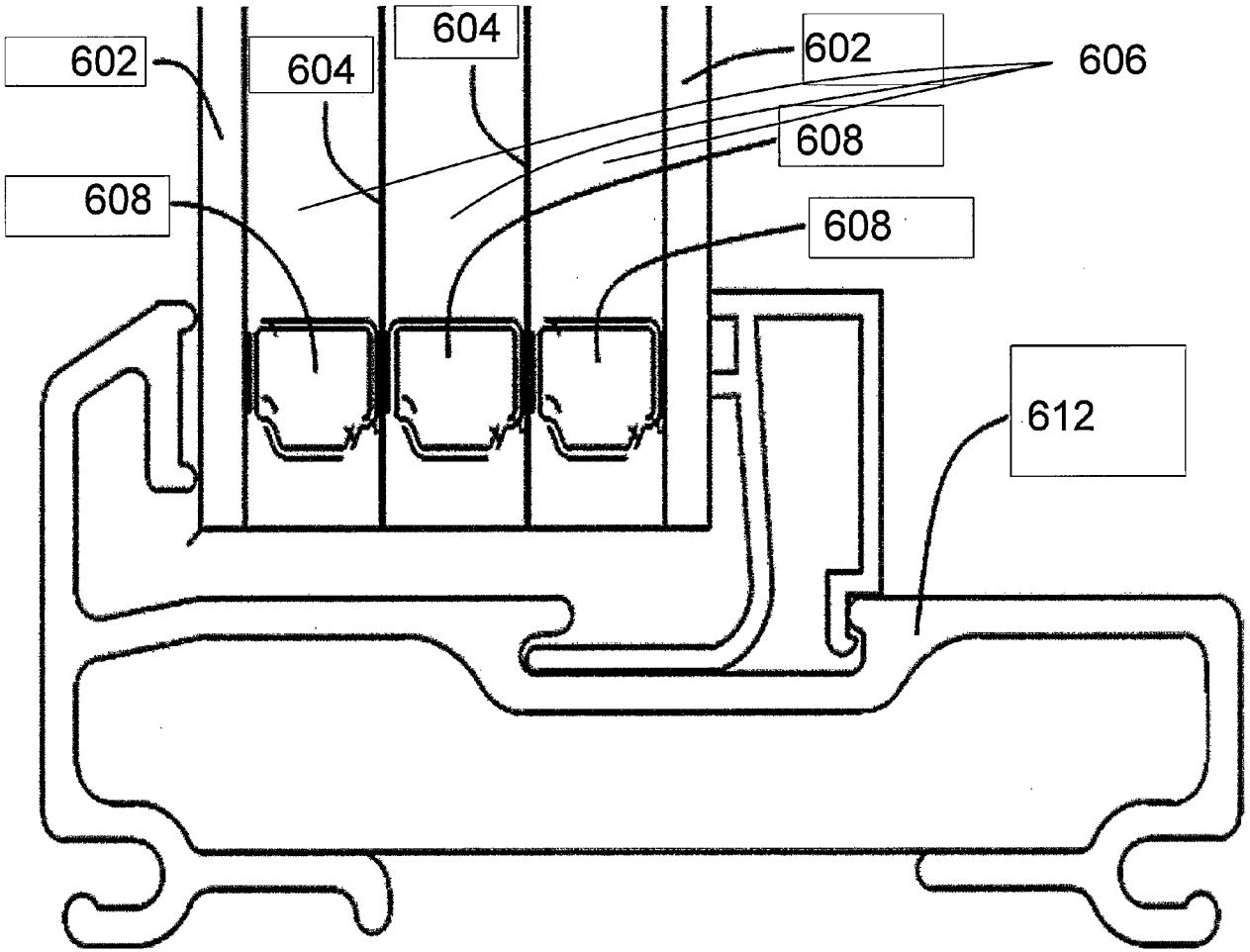
FIG. 7 is a cross section view of yet another embodiment of a window assembly that incorporates the insulated glass unit into a window frame.

Other instances of the embodiment disclosed above have been modeled using THERM, to demonstrate further the improvement in the thermal performance of the system introduced by the present invention. The embodiment used for the testing is illustrated in FIG. 7. In one instance, the base case consists of spacers 608 made of 6 mm deep steel tubes rolled and welded to a square cross section. In this configuration, the spacers 608 of FIG. 7 will be referred to as "6 mm steel" (cf. Table I and Table II below). The resulting U-factor and R-value for the structure were 0.108 and 9.3, respectively. Replacing the three 6 mm steel tube spacers with three aerogel spacers as in the embodiment illustrated in FIG. 2*b*, the resulting U-factor and R-value for the structure are 0.077 and 13.0, respectively. Thus, in this embodiment an improvement of more than 28% has been achieved by using this invention. Tables I and II show a total of 10 more instances that have been modeled using THERM, and will be discussed below. Again, all cases are referred to the embodiment of the invention depicted in FIG. 7.

Table I corresponds to a window structure where the leftmost component 602 is a ⅛ inch thick "Cardinal 272 Low E" pane and the rightmost is ⅛ inch thick "clear glass", a common window material sold by OldCastle Glass, Cardinal Glass and others. Components 604 were PET polyester film SC75 manufactured by Southwall Technologies of Palo Alto, Calif. The three voids 606 of the insulated glass unit 600 were filled with Krypton gas (90%), a typical thermal insulator. The window frame 612 used in this embodiment was a fiberglass frame (model 325, with a 1⅜ inch deep insulated glazing unit pocket depth) manufactured by Inline Fiberglass of Toronto, Ontario. A detailed description of Table I follows.

Case 1 corresponds to prior art, using the 6 mm steel tube spacers mentioned above. Case 2 corresponds to the embodiment of case 1, except with spacer 2 being replaced by the spacer embodied in FIG. 2*e*, where the stiffening material is steel. This particular embodiment of the spacer 608 is referred to as "aerogel w/steel" in Table I and Table II. Case 3 corresponds to the embodiment of case 1, except with spacer 2 being replaced by the spacer embodied in FIG. 2*b*. This particular embodiment of the spacer 608 is referred to as "aerogel solid" in Table I and Table II. Case 4 corresponds to the embodiment of case 1, except with spacer 1, spacer 2 and spacer 3 being replaced by spacers in the embodiment of FIG. 2*e* referred to as "aerogel w/steel". Case 5 corresponds to the embodiment of case 1, except with spacer 1, spacer 2, and spacer 3 being replaced by spacers in the embodiment of FIG. 2*b* referred to as "aerogel solid". The results in terms of the U-factors and the R-values are listed in columns 5 and 6 of Table I, respectively. A gradual improvement in the thermal performance of the structure is clearly seen, as the prior art steel spacers are replaced, one by one, by the aerogel spacers disclosed in the present invention. The thermal performance is improved in this case by up to 29.9% (R-value).

Table II corresponds to a window structure different from that of Table I in that only one of the components 604 is present, so only 3 panes and 2 spacers are involved. Also, the window frame in this case corresponds to model 325, 1", from Inline Fiberglass, Toronto, Ontario. All other components and materials are the same as in the structure of Table I. Cases 6 through 10 were modeled with this configuration, with case 6 corresponding to prior art, and case 10 corresponding to the two steel spacers in the structure being replaced with aerogel spacers. A detailed description of Table II follows.

Case 6 corresponds to prior art, using the 6 mm steel tube spacers mentioned above. Case 7 corresponds to the embodiment of case 6, except with spacer 2 being replaced by the spacer in the embodiment of FIG. 2*e* referred to as "aerogel w/steel". Case 8 corresponds to the embodiment of case 1, except with spacer 2 being replaced by the spacer in the embodiment of FIG. 2*b* referred to as "aerogel solid". Case 9 corresponds to the embodiment of Case 1, except with spacer 1, and spacer 2 being replaced by spacers in the embodiment of FIG. 2*e* referred to as "aerogel w/steel". Case 10 corresponds to the embodiment of Case 1, except with spacer 1, and spacer 2 being replaced by spacers in the embodiment of FIG. 2*b* referred to as "aerogel solid". The results in terms of the U-factors and the R-values are listed in columns 5 and 6 of Table II, respectively. The gradual improvement in the thermal performance of the structure is clearly seen, as the prior art steel spacers are replaced, one by one, by the aerogel spacers disclosed in the present invention. The thermal performance is improved in this case by up to 21.48% (R-value). The results reported above constitute a solid body of evidence revealing an astounding improvement in thermal properties of the disclosed invention over current window technologies.

TABLE I

| System Config. ID | Spacer 1 | Spacer 2 | Spacer 3 | U-factor | R-value | R-value increase | % R-value increase |
|---|---|---|---|---|---|---|---|
| 1 (prior art) | 6 mm steel | 6 mm steel | 6 mm steel | 0.126 | 7.94 | | |
| 2 | 6 mm steel | aerogel w/ steel | 6 mm steel | 0.109 | 9.17 | 1.24 | 15.60 |
| 3 | 6 mm steel | aerogel solid | 6 mm steel | 0.105 | 9.52 | 1.59 | 20.00 |
| 4 | aerogel w/ steel | aerogel w/ steel | aerogel w/ steel | 0.099 | 10.10 | 2.16 | 27.27 |
| 5 | aerogel solid | aerogel solid | aerogel solid | 0.097 | 10.31 | 2.37 | 29.90 |

TABLE II

| System Config. ID | Spacer 1 | Spacer 2 | Spacer 3 | U-factor | R-value | R-value increase | % R-value increase |
|---|---|---|---|---|---|---|---|
| 6 (prior art) | 6 mm steel | 6 mm steel | N/A | 0.164 | 6.10 | | |
| 7 | 6 mm steel | aerogel w/ steel | N/A | 0.145 | 6.90 | 0.80 | 13.10 |
| 8 | 6 mm steel | aerogel solid | N/A | 0.141 | 7.09 | 0.99 | 16.31 |
| 9 | aerogel w/ steel | aerogel w/ steel | N/A | 0.139 | 7.19 | 1.10 | 17.99 |
| 10 | Aerogel solid | aerogel solid | N/A | 0.135 | 7.41 | 1.31 | 21.48 |

Other embodiments of this invention will be obvious in view of the above descriptions.

What is claimed is:

1. A structure which comprises:

at least two glass sheets;

a spacer positioned and bonded between two of said at least two glass sheets about the perimeter of said at least two glass sheets, said spacer including a first contact surface, a second contact surface and a front surface facing into the space between said at least two glass sheets, said first contact surface, said second contact surface and said front surface each including a first cladding material, and said first contact surface and said second contact surface contacting, respectively, a different one of said at least two glass sheets; the spacer further comprising;

an aerogel forming a cross section with at least four surfaces including the first contact surface, the second contact surface, and the front surface;

one or more coatings of material on the at least four surfaces of said aerogel suitable for allowing the spacer to be formed to exact dimensions;

a first sealant forming a vapor and gas barrier on a surface of said spacer facing away from said front surface; and a second sealant overlying said first sealant and of a different material than said first sealant; wherein the first sealant and the second sealant are placed around the outer perimeter of the structure.

2. A structure as in claim 1 wherein said first cladding material comprises a non-woven sheet.

3. A structure as in claim 1 wherein said second sealant comprises a water vapor and a gas barrier differing from said first sealant.

4. A structure as in claim 1 wherein said first and said second sealant are each selected from a group consisting of polyisobutylene, polyurethane, polysulphide, 1-part silicone, and 2-part silicone, polyester films, polyvinylfluoride films, any other appropriate material which prohibits the transfer of vapor, a metalized film, and a metalized polyester film.

5. A structure as in claim 1 wherein said second sealant is selected from the group of materials consisting of acrylic adhesives, pressure sensitive adhesives, hot melt, polyisobutylene, polyurethane, polysulphide, and butyl materials known to have utility for bonding to said first sealant.

6. A structure as in claim 1 including a third sheet of glass separated from one of said at least two glass sheets by a second spacer bonded between said one of said at least two glass sheets and said third sheet of glass about the perimeter of said one of said at least two glass sheets and said third sheet of glass, said second spacer including a first contact surface, a second contact surface and a front surface facing into the space between said third sheet of glass and said one of said at least two glass sheets, said first contact surface of said second spacer, said second contact surface of said second spacer and said front surface of said second spacer each including a first cladding material, said first contact surface of said second spacer contacting said one of said at least two glass sheets and said second contact surface of said second spacer contacting said third sheet of glass.

7. A structure as in claim 6 including at least one sealant material around the periphery of said structure.

8. A structure as in claim 7 wherein said at least one sealant is selected from the group consisting of polyester films, polyvinylfluoride films, any other appropriate material which prohibits the transfer of vapor, a metalized film, and a metalized polyester film.

9. A structure as in claim 1 including an intermediate structure between said the at least two glass sheets, said intermediate structure comprising one or more high thermal performance sheets, said intermediate structure being separated from said two glass sheets by two spacers around the peripheries of said intermediate structure and said two glass sheets, each of said two spacers comprising an aerogel material and each of said two spacers separating said intermediate structure from a corresponding one of said two glass sheets.

10. A structure as in claim 9 wherein said one or more high thermal performance sheets comprises two high thermal performance sheets, wherein each high thermal performance sheet comprises a multi-layer metalized sheet of polyester film which reflects infrared energy, said two multi-layer metalized sheets of polyester film being separated around their periphery by a spacer comprising aerogel.

11. A structure as in claim 9 wherein said one or more high thermal performance sheets comprise two high thermal performance sheets separated by a spacer comprising aerogel.

12. A structure which comprises:

at least two glass sheets;

an intermediate structure between said two glass sheets, said intermediate structure comprising two high thermal performance sheets separated by a spacer, said intermediate structure being separated from said two glass sheets by a first spacer and a second spacer around the peripheries of said intermediate structure and said two glass sheets, each of said first and second spacer separating said intermediate structure from a corresponding one of said two glass sheets; further wherein at least one of the first spacer, the second spacer, and the spacer separating the two high thermal performance sheets are made of an aerogel forming a cross section with at least four surfaces, the spacer having at least one additional structural element to stiffen said aerogel and one or more coatings of material on the at least four surfaces of said aerogel suitable for allowing the spacer to be formed to exact dimensions; and a first sealant forming a vapor and gas barrier on a surface of the first spacer, the second spacer, and the spacer separating the two high thermal performance sheets; and a second sealant overlying said first sealant and of a different material than said first sealant; wherein the first sealant and the second sealant are placed around the outer perimeter of the structure.

13. A structure as in claim 12 wherein at least one of the first spacer, the second spacer, and the spacer separating the two high thermal performance sheets is filled with an aerogel.

14. A structure as in claim 12 wherein at least one of the first spacer, the second spacer, and the spacer separating the two high thermal performance sheets is made of a solid aerogel.

15. A structure as in claim 12 wherein the at least one additional structural element to stiffen said aerogel comprises two parallel pieces of steel separated by the aerogel.

16. A spacer for separating two panes of glass in a window thereby to decrease the heat transfer through the window, said spacer comprising:

an aerogel forming a cross section with at least four surfaces; and one or more coatings of material on the at least four surfaces of said aerogel suitable for allowing the spacer to be formed to exact dimensions;

a first contact surface formed by the one or more coatings on one of the at least four surfaces, a second contact surface formed by the one or more coatings on one of the at least four surfaces, and a front surface formed by the one or more coatings on one of the at least four surfaces;

a first sealant forming a vapor and gas barrier on a surface of said spacer facing away from said front surface; and a second sealant overlying said first sealant and of a different material than said first sealant; wherein the first sealant and the second sealant are placed around the outer perimeter of the spacer and the two panes of windows.

17. The spacer of 16 wherein the aerogel, the cross section with at least four surfaces, and the one or more coatings are selected to reduce a U-factor in the window by at least 25%.

18. The spacer as in claim 16 wherein one of said coatings of material on the at least four surfaces of said aerogel comprises a desiccant-impregnated hot melt adhesive.

19. The spacer of claim 16 including at least one additional structural element to stiffen said aerogel.

20. The spacer of claim 19 wherein said additional structural element comprises a material selected from the group consisting of metal, resin and plastic.

21. The spacer of claim 20 wherein said additional structural element is applied to said spacer so as to cover the front surface of the spacer.

22. The spacer of claim 21 wherein said additional structural element includes material which extends into or along said spacer away from the front surface of the spacer.

23. The spacer of claim 19 wherein said additional structural element includes a metal strip that runs along and parallel with the first contact surface and the second contact surface, in order to limit heat conduction across the spacer and provide strength to the spacer along its length.

24. The spacer of claim 19 wherein said additional structural element can be in any orientation with regard to the first contact surface and the second contact surface, in order to provide extra strength to the structure.

25. The spacer of claim 16 wherein at least one of said one or more coatings comprises a material selected from the group consisting of a plastic, a nonwoven fabric, aromatic nylon, a butyl, and a metal foil.

26. The spacer of claim 25 wherein said plastic comprises a vinyl.

27. The spacer of claim 16 wherein at least one of said one or more coatings comprises a material selected from the group consisting of a resin and a hot melt adhesive.

28. The spacer of claim 16 wherein said aerogel comprises a fiber reinforced aerogel.

* * * * *